United States Patent [19]

Dornes

[11] Patent Number: 4,915,002

[45] Date of Patent: Apr. 10, 1990

[54] MUSIC SYNTHESIZER ADJUNCT

[76] Inventor: John Dornes, 69 Mercer St., New York, N.Y. 10012

[21] Appl. No.: 318,419

[22] Filed: Feb. 28, 1989

Related U.S. Application Data

[63] Continuation of Ser. No. 2,233, Jan. 12, 1987, abandoned.

[51] Int. Cl.[4] ..... G10H 1/02; G10H 3/06; G10H 1/46

[52] U.S. Cl. ..... 84/692; 84/701

[58] Field of Search ..... 84/1.24, 1.18, DIG. 7, 84/453, 1.01, 1.19, 1.21, 1.25, 1.27; 74/594.5, 551.5

[56] References Cited

U.S. PATENT DOCUMENTS

| | | | |
|---|---|---|---|
| 458,608 | 9/1891 | Wheeler | 74/594.5 |
| 553,638 | 1/1896 | Bailey | 74/594.5 |
| 592,801 | 11/1897 | Macy | 74/594.5 |
| 3,045,522 | 7/1962 | Markowitz et al. | 84/1.18 |
| 3,358,070 | 12/1964 | Young | 84/1.24 |
| 3,553,336 | 1/1971 | Markowitz et al. | 84/1.24 X |
| 3,558,793 | 1/1971 | Nakada | 84/1.24 X |
| 3,562,399 | 2/1971 | Yamauchi | 84/1.18 X |
| 3,598,890 | 8/1971 | Suzuki | 84/1.24 X |
| 3,624,583 | 11/1971 | Nakada | 84/1.24 X |
| 3,681,507 | 8/1972 | Slaats et al. | 84/1.24 X |
| 4,170,916 | 8/1979 | Fritz et al. | 84/1.24 |
| 4,546,245 | 10/1985 | Cooper et al. | 84/1.18 X |

FOREIGN PATENT DOCUMENTS

| | | | |
|---|---|---|---|
| 52-043416 | 4/1977 | Japan | 84/1.27 |
| 1097643 | 6/1984 | U.S.S.R. | 84/1.25 |

*Primary Examiner*—A. T. Grimley
*Assistant Examiner*—Matthew S. Smith
*Attorney, Agent, or Firm*—Eric P. Schellin

[57] ABSTRACT

A music synthesizer has a pivotable and slidable bar mounted in front of the keyboard of the synthesizer, the bar disposed generally parallel thereto whereby a wrist of a player may cause the bar either to pivot about an external hinge or pivot, or to slide about an axis of the bar. An actuating member is provided which responds to motion of the bar to mechanically operate potentiometers of the synthesizer to provide variably positioned dependent analog signals as inputs to the synthesizer.

7 Claims, 4 Drawing Sheets

Fig. 2
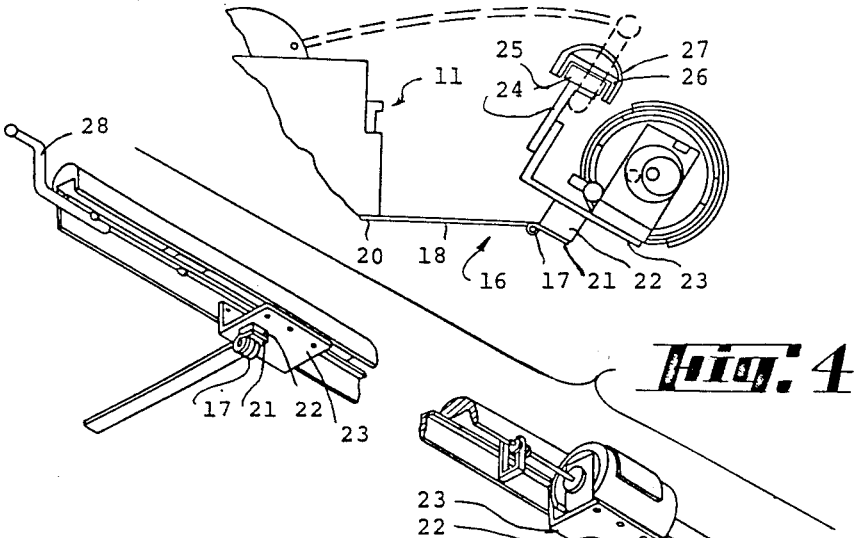
Fig. 4
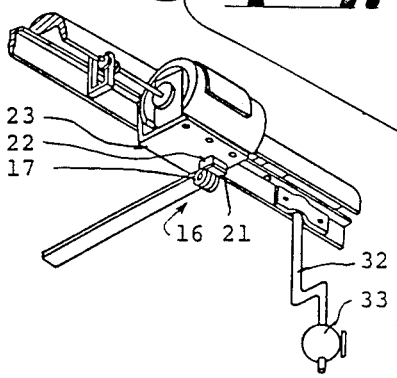
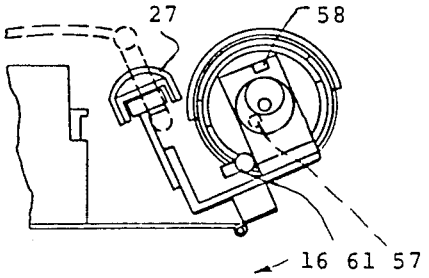
Fig. 3

MUSIC SYNTHESIZER ADJUNCT

This is a continuation of application Ser. No. 002,233, filed Jan. 12, 1987, now abandoned.

BACKGROUND OF THE INVENTION

Electronic keyboards of music synthesizers are presently equipped with what are termed "performance control" devices usually in the form of wheels or levers located at the left of the keyboard. They are able to alter various synthesizer functions such as pitch bend and modulation.

Volume is usually available in the form of a knob or sliding potentiometer. In addition, it is presently possible to actuate some of these functions by the use of foot pedals or breath control when such are provided. The disadvantage of this is evident when it becomes necessary for the performer to remove one hand from the business of playing the keys to engage the pitch or modulation wheels and to operate one or the other as desired.

In some prior art devices, pedals are sometimes provided and employed for the many different functions to be dealt with, e.g. sustain portamento, volume, modulation, and the like. In addition thereto foot switches may be provided to control effects, e.g., pitch change, drum machine, etc. that it can be confusing and difficult to achieve an expressive performance.

It is the intent of this invention to create a device capable of a plurality of different motions simultaneously or separately. Each distinct motion is capable of being assigned and transmitted, electronically or mechanically, to various "performance parameters" and to other useful destinations. It is the object to achieve the above intent without the necessity of the performer removing either hand from the keys of the keyboard.

The device hereinafter disclosed comprises a framework upon which is articulated one or more movable components placed in such a way that they can be easily controlled and moved by a portion of the wrist or flat of the hand at the same time as the fingers of the hand play the keys of the keyboard.

The object of the device of the present invention is to allow a keyboard performer to control, in real time and in a personally expressive manner, any individual or combination of sound modifying parameters without the necessity of either the hands leaving the keyboard.

SUMMARY OF THE INVENTION

The principle motions capable of the device is a counterbalanced forward and back motion means, similar in direction to the existing motion that a pitch wheel makes. There is provided a horizontally positioned framework mounted on pivot points and counterbalanced in such a way that deflection upon it can cause it to arcuately move as desired in a foward and back motion; such motion being able with the use of mechanical linkage to communicate itself to the pitch or modulation devices of an existing music synthesizer. Another way of putting it: the entire framework would be connected by a lever to the existing pitch wheel of the host music synthesizer permitting deflection along any point of the device framework to be transmitted to the pitch wheel. The motion resulting is a change in pitch.

A second motion available on the same bar adjacent to the synthesizer is from side to side i.e. to and fro. This bar connects to a potentiometer, optical or mechanical, which would be assigned to control synthesizer functions. Thus, on this same bar, the performer is allowed the control of two separate motions in and out or forward and back, and side to side. The player is allowed to control these motions separately or together, in varying desired amounts.

In addition to the first bar there is a second bar of tubular configuration which is a control surface comprising of a semi-circular cylinder articulated on a bearing surface, capable of lateral and/or rotary motion. This motion is transmitted to optical or mechanical potentiometers and then to an electric signal processor capable of altering music synthesizer sound modifying parameters.

Both the first bar and the second bar are parallel and mounted close together and in proximity to the keys. They are adapted and constructed to be moved by a portion of the hand between fingers and lower arm. These motions, separately or together, in a wide variety of complex and simple patterns, are capable of altering or modifying the sound parameters of the music synthesizer. Examples: (I) Pitch, volume, and modulation are easily modified with either hand from any point on the keyboard with a back and forth wrist movement which, in contact with the bar, could elicit vibrato in much the same manner as a cellist or violinist. Sound volume levels could appropriately be increased or diminished expressively at will. (II) It is also possible to configure either bar to permit a cross-fade between two different sound sources (Sound A would slowly fade while mixing gradually with Sound B until only B was heard). This is also useful for mixing and varying other special effects such as phasing, flanging, echo, delay, etc.

The entire framework of this device is balanced with the use of an adjustable counterweight. By varying the distance of the counterweight from the fulcrum of the device, the "feel" or deflection needed to articulate the device can be adjusted to suit the performer. The adjustment of this counterweight could result in the entire device remaining in a fixed forward or backward position, as desired, to enable the pitch wheel to perform a predetermined pitch interval.

BRIEF DESCRIPTION OF THE DRAWINGS

FIG. 3 is the same open end view with the device in the other position;

FIG. 7 is a diagrammatic view from the side of an exposed left side module;

FIG. 8 is a diagrammatic view from the side of an exposed right side module.

DETAILED DESCRIPTION OF THE INVENTION

The device of the present invention is shown to be an add-on to conventional music synthesizers of known types. It is pointed out that the device of the present invention may also be manufactured as part of original musical equipment.

Figure 1:
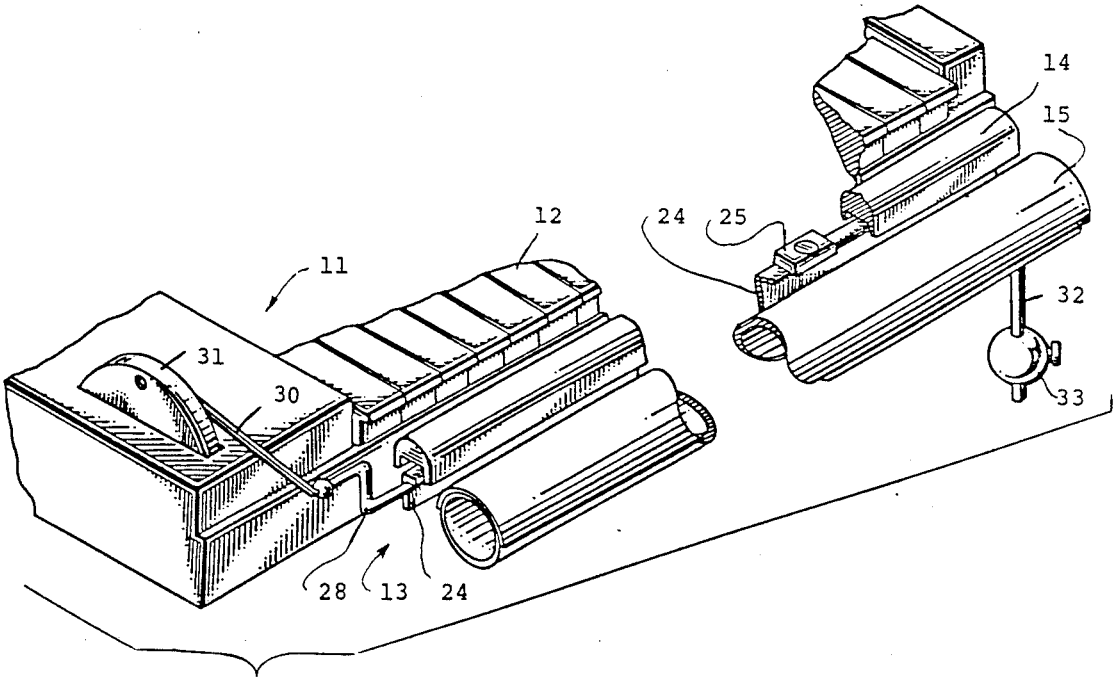
FIG. 1 is a broken away perspective of the device of the instant invention mounted before the keyboard of a music synthesizer.

FIG. 1 depicts a portion of a music synthesizer 11 having a keyboard 12 to which has been fitted the device of the present invention 13, shown in fragmentary form. It will be appreciated that both the keyboard 12 and the device 13 are elongated and are normally addressed by an individual either sitting or standing therebefore in order to play the keyboard with the fingers of the hand and the device 13 with the downwardly facing wrists of either or both wrists.

Figure 2:
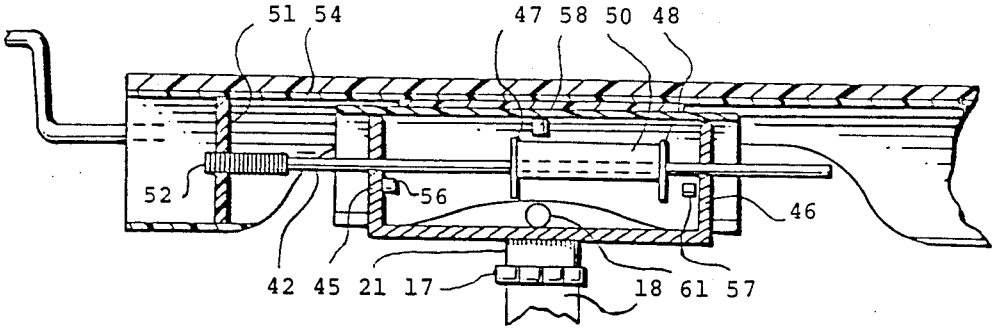
FIG. 2 is an open end view with the device in one position.

The device 13 includes first elongated control member 14 and a second elongated control member 15. The two control members are both mounted in tandem on a frame member 16 as can be discerned from FIGS. 2, 3 and 4. The frame 16 is mounted at hinge 17 to a plate 18 and the distal end 20 is mounted to the underside of the keyboard portion of the music synthesizer by suitable means such as screws, bolts and the like. From FIG. 4, it will be seen that the frame 16 consists of at least one in number, but it will be appreciated that more may be included as desired to thereby achieve greater versability and diversity.

Plate 21 constituting a leaf of the hinge carries an upwardly standing member 22 to which the longer portion of an L-shaped plate 23 is secured. The shorter portion of the L-shaped plate 23 has mounted to it the first control member 14. The longer portion of the L-shaped plate 23 has mounted to it the second control member 15.

The fitment for the first control member 14 includes an elongated angle member 24 the lower portion of which is affixed to the shorter portion of the L-shaped plate 23. The upwardly facing portion of the angle member 24 has affixed thereto a plurality of friction reducing blocks 25. It is contemplated that a single suitably dimensioned elongated block may be employed. The control member 14 includes an elongated downwardly facing U-shaped member 26 which is embraced at its leg portions by a larger downwardly facing elongated U-shaped element 27. The upperwardly facing portion of element 27 has a friction producing surface upon which a portion of the user's wrist or wrists may lie as desired for operation.

From FIG. 1 at one end of elongated angle member 24 there extends a bell crank member 28 which is affixed to one end of a rod 30. The other end of the rod 30 is adapted and constructed to rotatably move conventional potentiometer wheel 31 of the music synthesizer 11.

The other end of the elongated angle member 24 has mounted thereto a downwardly disposed bell crank rod 32 to which is mounted a movable counter weight 33, the positioning of which affects the at rest position of the control members 14 and 15 as they pivot in unison about hinge 17.

Figure 6:
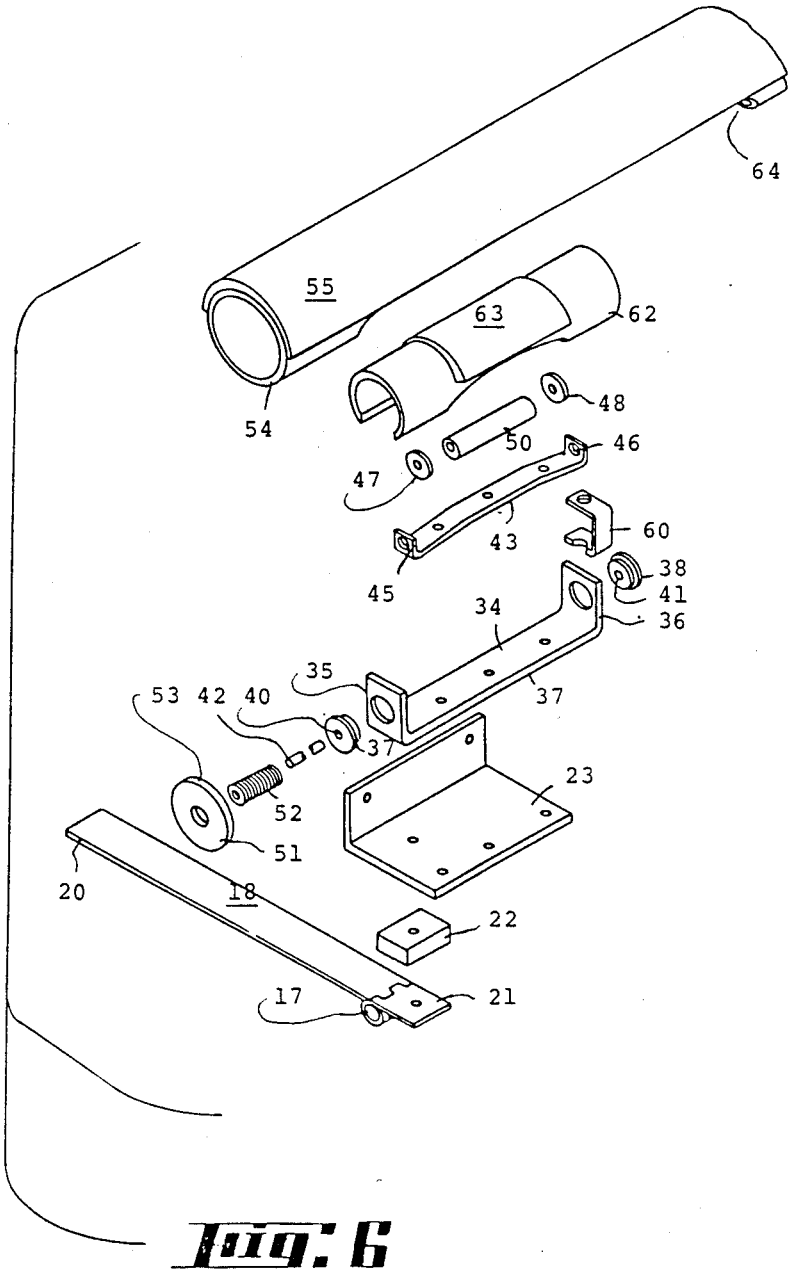
FIG. 6 is an exploded view of a fragmentary portion of the device.
Figure 4:
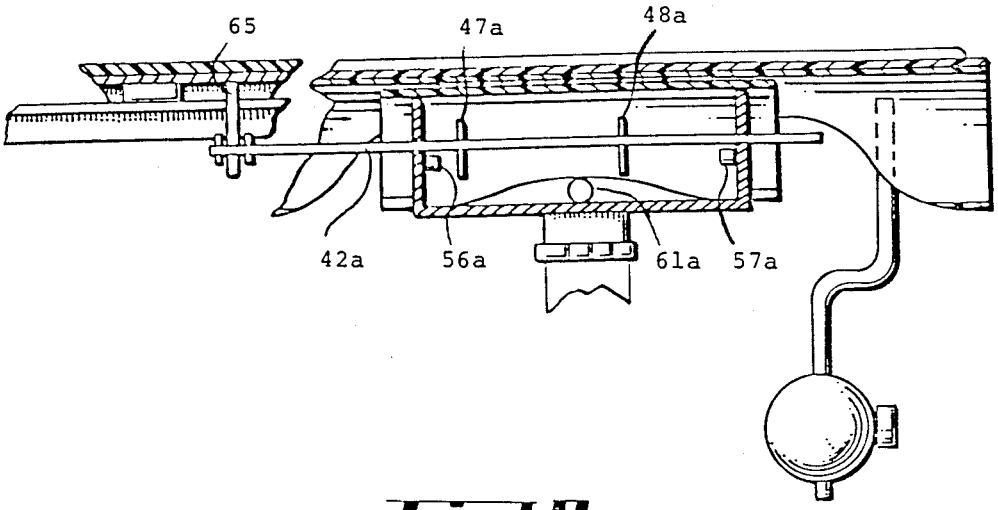
FIG. 4 is a broken away perspective of the device taken from the bottom.

The other or second controller 15 is mounted on the long leg of L-shaped plate 23 of which there is a pair. For a detailed consideration of the mechanisms involving the controller 15 attention is directed to Fig. 6, as well as FIGS. 2, 3 and 4. FIG. 4 depicts the two pivoting means. At the left side of the figure the hinged mounting frame member 16 is devoid of the remaining elements for the controllers 14 and 15 respectively. While to the right side of the FIG. 4 is depicted the second of the pair of frame member 16 to which has been affixed the elements of controllers 14 and 15.

Figure 5:
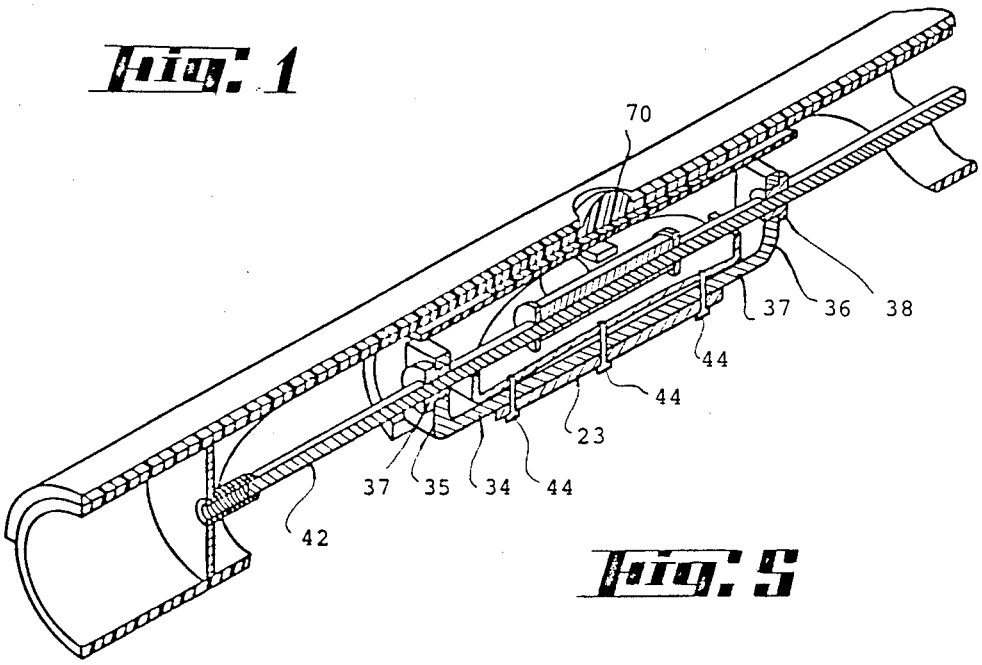
FIG. 5 is perspective cross-section of a fragmentary position of the device.

Controller 15 includes an upstanding U-shaped holder 34 which has upstanding legs 35 and 36, depicted as being at the left of controller 15, as illustrated by FIG. 5. The bridging portion 37 of holder 34 is secured by suitable means to the longer portion of L-shaped plate 23. Each of the legs 35 and 36 have axially aligned horizontally disposed bores therethrough; each of which is fitted with journal bushings 37 and 38 having bores 40 and 41, respectively through which elongated rod 42 extends, shown in fragmentary condition in FIG. 6, but shown also in FIG. 5.

A second smaller U-shaped member 43 is positioned within U-shaped holder 34 and is secured thereto by fastening means 44 together with the U-shaped holder 34 to the longer portion of plate 23. Elongated rod 42 passes through bores 45 and 46 of the upstanding legs of U-shaped member 43.

Between the legs of U-shaped member 43, there is mounted fixedly on rod 42 horizontally displaced first disc 47 and second disc 48. The space between said discs is occupied by eccentrically mounted tube 50. At the far end of rod 42 is mounted a large disc 51 by means of spring connector 52. The peripheral portion 53 is designed to frictionally engage the inner cylindrical wall of elongated tube 54 where rotation movement is given to disc 51 when tube is pivoted and disc 51 follows back and forth when tube 54 is moved to and fro by means of wrist action of the player. The tube 54 has mounted thereon a friction producing covering 55 to enhance the ability of the player to move the tube 54 from side to side and pivotally as desired.

Attention is now directed to FIG. 7. In oppositely facing relationship on the legs of U-shaped holder 43 there is mounted a first photoelectric cell 56 and a second photoelectrical cell 57. A third photoelectric cell 58 is mounted at the top of a U-shaped bracket 60 which is mounted by means of one of its legs centrally between bridging portion 37 of the U-shaped holder 34 and the bridging portion of U-shaped holder 43. A small electric light bulb and socket 61 is mounted centrally between the legs of U-shaped holder 43.

The mechanism is surrounded by protective arcuate cover 62 which is affixed to and supported by the U-shaped holder 34. The cover 62 carries an outwardly facing friction reducing means 63. The enclosed unit is called a first module.

Tube 54 is positioned over cover 62 and the contents therein under through elongated opening 64 at the bottom of the tube 54, i.e., the first module.

What has been described in the immediate foregoing is the left side of the device of the present invention. At the right side thereof is a similar construction with a number of differences as can more readily be seen from FIG. 8 which depicts this portion somewhat diagrammatically. This is termed the second module. It will be noted that tube 50 between discs 47*a* and 48*a* does not have a counterpart. Similarly, there is no photoelectric cell 58, as on the left side or first module. Also there is no friction wheel for engagement internally of tube 54. On the contrary an attaching bracket 65 is attached to sliding controller 14 at one end thereof. The other end is connected in journalling fashion to one end of rod 42*a*. In operation, as controller 14 is moved horizontally from side to side the; rod 42(*a*) and its associated discs 47*a* and 48*a* move to and fro. From FIG. 8 it will be noted that photoelectrical cells 56*a* and 57*a* are presently adapted and constructed to receive light from electric light 61*a*.

For consideration of the operation one component of the device, attention is directed to FIG. 7. When the rod 42 is positioned whereby discs 47 and 48 are equidistant to either side of electric light 61 both photoelectric cells 56 and 57 receive full illumination from the electric light 61. As controller 15 is moved to the right as shown in FIG. 7, disc 48 gradually interrupts some of the light to photoelectric cell 57 to thereby diminish its output electrically in a known fashion. The light impinging onto photoelectrical cell 56 goes unabated. Similarly, as tube 54 is rotated, eccentric tube 50 will rotate. As it is eccentric it will interfere with the path of light from the electric light 61 to photocell 58 and thereby vary the output therefrom.

It will be seen therefrom that rotating tube 54 will result in an output signal from photoelectric cell 58. Concomitantly, to and fro sliding motion will result in a variable output from photoelectric cells 56 and 57, that is, as the output from one photoelectric cell increases the other is diminished. Note the path of the light as described by dotted lines.

Turning to FIG. 8, it will be noted that as controller 14 is moved to and fro horizontally there is a variation in output from photoelectric cells 56*a* and 57*a*, that is, as the output from one photoelectric cell increases the other is diminished. Note the path of the light as described by dotted lines.

By means of the foregoing a good illustration of the preferred embodiment of the invention has been set forth. While a left sided module and a right sided module have been disclosed with the left one supplying three electric variable outputs and the right one supplying two electric variable outputs it should be noted that additional modules may be included for supplying yet additional outputs to vary functions as desired.

Another feature of the invention is the use of electric light bulb 61 at the left side, that is, module. By providing for a window in cover 62 and tube 54 and friction cover 55 adapted and constructed to be in alignment with each other and to view the light through lens 70 when controller 15 is in a normal at rest position. When the light is visible those items controlled by controller 15 are at a preset selected normal condition from whence there may be achieved deviations as herein above discussed.

Likewise by controlling the fulcrum point about hinge 17 the device so hinged will always return to the preselected position when no pivoting pressure is applied thereto to vary its angularity with respect to the device's position from the keyboard.

The various outputs from the photoelectric cells are employed as inputs to components of the music synthesizer or to adjuncts thereto to modify the musical rendition emanating in accordance with the component so receiving the outputs from the photoelectric cells. Such components are well known in the art and are conventionally provided with jack inputs so that suitable wiring harnesses will be necessary to carry the electric signals from the various photoelectric cells to the inputs ports.

The various components of the device of the invention may be constructed of metal for strength reasons or may be made of plastic if such materials provide sufficient rigidity as required.

It will be appreciated that the device of the present invention may be constructed in one embodiment whereby only controller 14 is present. On the other hand it may be constructed whereby only the controller 15 is present. In the third and preferred embodiment both controller 14 and controller 15 are combined to give a great number of position dependent analog signals for processing by the music synthesizer directly or by some additional synthesizer associated therewith.

The foregoing is considered illustrative of the principles of the invention, and since modifications and changes may occur to those skilled in the art, it is not desired to limit the invention to the exact construction and operation shown and described. Accordingly, all suitable modifications and equivalents may be resorted to, falling within the scope of the invention as claimed.

What is claimed is:

1. A variable control device accessory for a music synthesizer having an electric variable switch and having a horizontally disposed keyboard, the variable control device accessory being adapted and constructed to be positioned in front of the horizontally disposed keyboard and displaced therefrom comprising.

an elongated relatively slender bar dimensioned approximately the width of the horizontally disposed keyboard and being disposed at a plane approximately parallel therewith whereby at least one wrist of a player may rest on the elongated relatively slender bar while the player fingers the horizontally disposed keyboard in order to play the music synthesizer, said elongated relatively slender bar slidably mounted on a pivotable frame which is mountable with respect to said music synthesizer adapted and constructed to be displaceable in arcuate movement or in horizontal slidable movement parallel to the front of the horizontally disposed keyboard in response to the wrist action of the player, said elongated relatively slender bar having linkage means for mechanically operating said electric variable switch of said music synthesizer, and an adjustable counterweight mounted to said elongated relatively slender bar for returning said elongated relatively slender bar to a preselected normal position when said elongated relatively slender bar is released from a given position.

2. A variable control device accessory for a music synthesizer having a horizontally disposed keyboard, the variable control device being adapted and constructed to be positioned in front of the horizontally disposed keyboard comprising:

an elongated tube dimensioned approximately the width of the horizontally disposed keyboard and being disposed at a plane approximately parallel therewith whereby at least one wrist of a player may rest on the elongated tube while the player fingers the horizontally disposed keyboard in order to play the music synthesizer, said elongated tube being rotatably and slidably mounted on a frame which is mountable with respect to said music synthesizer whereby said elongated tube rotates or slides from side to side parallel to the front of the horizontally disposed keyboard in response to the wrist action of the player, at least one module operatively connected to said elongated tube, said at least one module having at least one light source and at least one photoelectrical cell in light receiving alignment with said at least one light source, means mounted in said at least one module for varying analog interruption of the light falling on said at least one photoelectric cell from said at least one light source as said elongated tube is rotated or as said elongated tube is moved from side to side thereby providing a variable output signal for processing by said music synthesizer.

3. A variable control device accessory for a music synthesizer having an electric variable switch and having a horizontally disposed keyboard, the variable control device being adapted and constructed to be positioned in front of the horizontally disposed keyboard and displaced therefrom comprising:

an elongated relatively slender bar dimensioned approximately the width of the horizontally disposed keyboard and being disposed at a plane approximately parallel therewith whereby at least on wrist of a player may rest on the elongated relatively slender bar while the player fingers the horizontally disposed keyboard in order to play the music synthesizer, said elongated relatively slender bar slidably mounted on a pivotable frame which is mountable with respect to said music synthesizer adapted and constructed to be displaceable in arcuate movement or in horizontal slidable movement parallel to the front of the horizontally disposed keyboard in response to the wrist action of the player, said elongated relatively slender bar having linkage means for mechanically operating said electric variable switch of said music synthesizer, and means for returning said elongated relatively slender bar to a preselected normal position when said elongated relatively slender bar is released from a given position, an elongated tube dimensioned approximately the width of the horizontally disposed keyboard and being disposed at a plane approximately parallel therewith whereby at least one wrist of a player may rest on the elongated tube while the player fingers the horizontally disposed keyboard in order to play the music synthesizer, said elongated tube being mounted on a frame and being adapted and constructed to be displaceable in rotatable movement or in horizontal slidable movement parallel to the front of the horizontally disposed keyboard in response to the wrist action of the player, at least one module operatively connected to said elongated tube, said at least one module having at least one light source and at least one photoelectrical cell in light receiving alignment with said at least one light source, means mounted in said at least one module for varying analog interruption of the light falling on said at least one photoelectric cell from said at least one light source as said elongated tube is rotated or as said elongated tube is moved from side to side thereby providing a variable output signal for processing by said music synthesizer.

4. The variable control device accessory according to claim 3 wherein the means for returning said elongated relatively slender bar is in the form of an adjustably mounted counterweight.

5. A variable control device accessory for a music synthesizer having a horizontally disposed keyboard, the variable control device being adapted and constructed to be positioned in front of the horizontally disposed keyboard comprising:

an elongated tube dimensioned approximately the width of the horizontally disposed keyboard and being disposed at a plane approximately parallel therewith whereby at least one wrist of a player may rest on the elongated tube while the player fingers the horizontally disposed keyboard in order to play the music synthesizer, said elongated tube being rotatably and slidably mounted on a frame which is mountable with respect to said music synthesizer whereby said elongated tube rotates or slides from side to side parallel to the front of the horizontally disposed keyboard in response to the wrist action of the player, at least one module operatively connected to said elongated tube, said at least one module having at least one potentiometer adapted and constructed to be operable when said elongated tube is rotated and at least one potentiometer adapted and constructed to be operable when said elongated tube is moved from side to side thereby providing variable output signals for processing by said music synthesizer.

6. A variable control device accessory for a music synthesizer having an electric variable switch and having a horizontally disposed keyboard, the variable control device being adapted and constructed to be positioned in front of the horizontally disposed keyboard and displaced therefrom comprising:

an elongated relatively slender bar dimensioned approximately the width of the horizontally disposed keyboard and being disposed at a plane approximately parallel therewith whereby at least one wrist of a player may rest on the elongated relatively slender bar while the player fingers the horizontally disposed keyboard in order to play the music synthesizer, said elongated relatively slender bar slidably mounted on a pivotable frame which is mountable with respect to said music synthesizer adapted and constructed to be displaceable parallel to the front of the horizontally disposed keyboard in response to the wrist action of the player, said elongated relatively slender bar having linkage means for mechanically operating said electric variable switch of said music synthesizer, and means for returning said elongated relatively slender bar to a preselected normal position when said elongated relatively slender bar is released from a given position, an elongated tube dimensioned approximately the width of the horizontally disposed keyboard and being disposed at a plane approximately parallel therewith whereby at least one wrist of a player may rest on the elongated tube while the player fingers the horizontally disposed keyboard in order to play the music synthesizer, said elongated tube being mounted on a frame and being adapted and constructed to be displaceable in rotatable movement or in horizontal slidable movement parallel to the front of the horizontally disposed keyboard in response to the wrist action of the player, at least one module operatively connected to said elongated tube, said at least one module having at least one potentiometer adapted and constructed to be operable when said elongated tube is rotated and at least one potentiometer adapted and contructed to be operable when said elongated tube is moved from side to side thereby providing variable output signals for processing by said music synthesizer.

7. The variable control device accessory according to claim 6 wherein the means for returning said elongated relatively slender bar is in the form of an adjustably mounted counterweight.

* * * * *